United States Patent [19]

Tiesman

[11] Patent Number: 4,549,654

[45] Date of Patent: Oct. 29, 1985

[54] ARTICLE DISPLAY PACKAGE AND BLANK THEREFOR

[75] Inventor: Randy J. Tiesman, Fulton, Ill.

[73] Assignee: Champion International Corporation, Stamford, Conn.

[21] Appl. No.: 668,968

[22] Filed: Nov. 7, 1984

Related U.S. Application Data

[63] Continuation of Ser. No. 499,216, May 31, 1983, abandoned.

[51] Int. Cl.[4] ..... B65D 73/00; B65D 5/50

[52] U.S. Cl. ..... 206/486; 206/476; 206/462; 206/488; 206/806; 248/152

[58] Field of Search ..... 206/486, 490, 476, 462, 206/471, 488, 806, 45.19; 248/152

[56] References Cited

U.S. PATENT DOCUMENTS

| | | | |
|---|---|---|---|
| 3,239,177 | 3/1966 | Samsing | 248/152 |
| 3,437,193 | 4/1969 | Freeman | 248/152 |
| 4,300,683 | 11/1981 | Roccaforte | 206/45.19 |
| 4,354,598 | 10/1982 | Schillinger | 206/462 |

*Primary Examiner*—William T. Dixson, Jr.
*Assistant Examiner*—Brenda J. Ehrhardt
*Attorney, Agent, or Firm*—Evelyn M. Sommer; John H. Mulholland; William W. Jones

[57] ABSTRACT

This package is particularly adapted for carrying an article to display the latter at the point of sale. The package is formed to stand on a shelf or to hang when the article is being displayed. It is created from a unitary paperboard blank and includes product retaining openings with product encircling edges to retain the product in the openings. The preferred embodiment of the package is adapted for use in carrying flashlights along with batteries carried separately by the package.

6 Claims, 8 Drawing Figures

ARTICLE DISPLAY PACKAGE AND BLANK THEREFOR

This application is a continuation of application Ser. No. 499,216, filed May 31, 1983, now abandoned.

BACKGROUND OF THE INVENTION

This invention is an improvement over U.S. Pat. No. 4,354,598 and relates to a display package for retaining an article so that the article is displayed at the point of sale either by standing on a shelf or by hanging from a hook. In particular, the preferred embodiment of the package of this invention is adapted to hold a flashlight, and, separately, batteries for operating the flashlight.

It is known in the prior art to provide specialized packages for containing articles so as to display the articles at the point of purchase. These packages are typically cards formed from paperboard which may or may not employ blister package components to display the article while retaining it in the card. This invention relates to an improved form of such a package formed from a folded paperboard blank which includes one or more openings for insertion of the packaged articles and includes paperboard article encircling opening edges for retaining the articles in the openings. In the preferred embodiment disclosed herein, the opening edges in the blank are particularly configured to contain a flashlight, and an additional opening may be provided to cooperate with a blister package to separately secure batteries to the package.

SUMMARY OF THE INVENTION

The package of this invention is formed from a paperboard blank having front and back major panels foldably connected together with an inner bottom flap and an outer integral base to create a reinforced triangular stand. Each major panel has formed therein an opening, which openings have edges which coincide with each other when the blank is folded to the erected condition. The opening edges are configured to the shape of a flashlight which is inserted into the openings so as to be held, yet displayed, by the opening edges and triangular stand. Auxiliary openings may also be provided to cooperate with a blister package to separately hold batteries for the flashlight.

It is, therefore, an object of this invention to provide a package for retaining an article while displaying the latter at the point of purchase either by standing the package on a shelf or by hanging on a hook.

It is a further object of this invention to provide a package of the character described which is formed from a folded paperboard blank having article receiving openings formed therein having opening edges for engaging the articles which are disposed in the article receiving openings and a triangular stand.

It is yet another object of this invention to provide a package of the character described which is particularly adapted for retaining flashlights.

These and other objects and advantages of the package of this invention will become more readily apparent from the following detailed description of a preferred embodiment thereof taken in conjunction with the accompanying drawings, in which:

DETAILED DESCRIPTION OF THE PREFERRED EMBODIMENT

Figure 1:
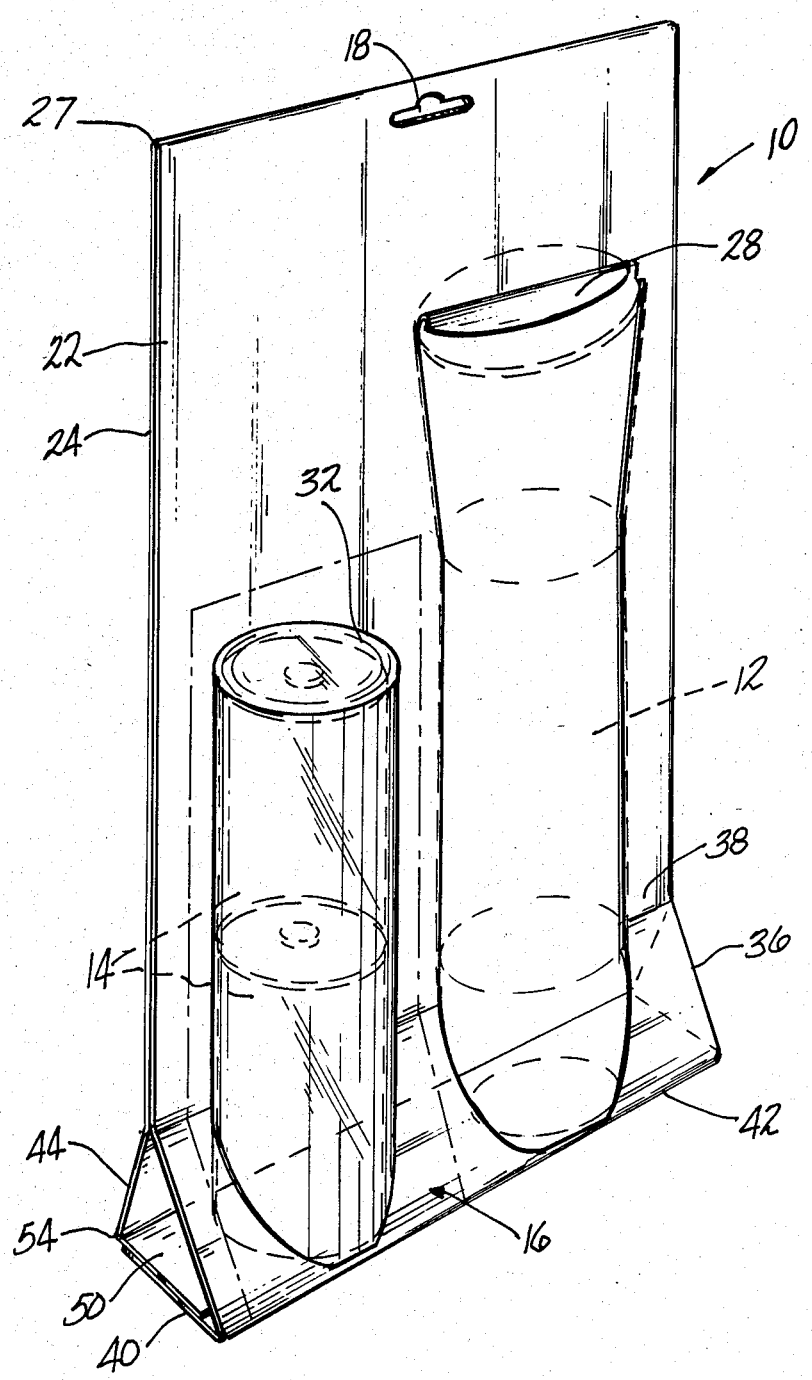
FIG. 1 is a perspective view of a preferred embodiment of the package of this invention.

Referring now to the drawings, there is shown in FIG. 1, a perspective view of a preferred embodiment of the package 10, constructed in accordance with the invention, with a flashlight 12, and batteries 14 shown in phantom. The package 10 includes both a reinforced triangular stand 16 and a hanger opening 18 for hanging the package, thus permitting display by means of standing on a shelf or hanging.

Figure 2:
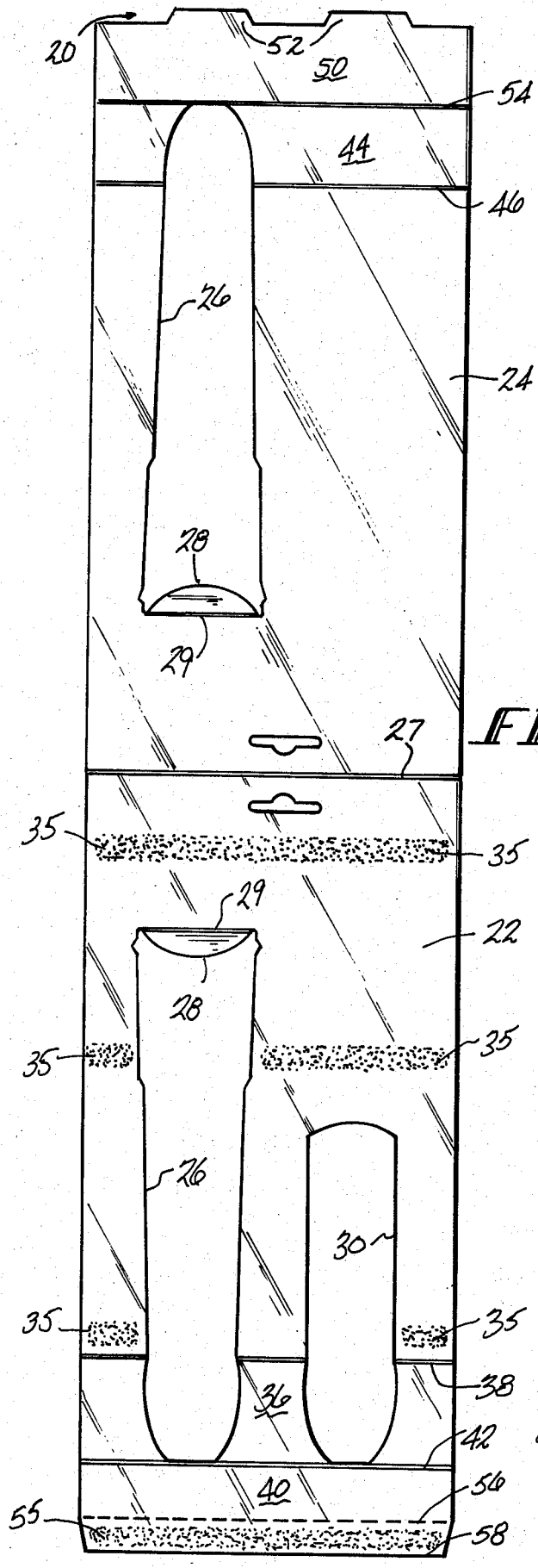
FIG. 2 is a plan view of the inside of a paperboard blank from which a preferred embodiment of the package of this invention is formed.

The blank, denoted generally 20 in FIG. 2, includes two major panels, a front panel 22 and a back panel 24 which are connected to each other by means of a fold line 27. The front and back panels 22 and 24 are each provided with first article receiving openings 26, both of which have edges which are contoured to encircle the shape of the particular flashlight to be held in the package 10. Curved flaps 28 extend down into the upper ends of the openings 26 from fold lines 29, the flaps 28 serving to engage the lens of the flashlight to urge it downwardly against the inside of stand 16.

The front panel 22 is provided with a second article receiving opening 30 which has edges which are contoured to retain a blister 32, having flanges 34, in which batteries 14 are contained and secured. The blister 32 and batteries therein is inserted in the opening 30 through openings 26 by means of a passageway between front and back panels 22 and 24. The passageway provides interior communication between openings 26 and 30 and is provided by means of the card flexibility and the absence of a glued area between front and back panels 22 and 24 in the area between openings 26 and 30. The passageway extends the full length of the second opening 30. The front and back panels are appropriately glued in other areas as shown in stippled areas 35.

The reinforced triangular stand 16 is formed at the lower end of the package 10 by means of adjacent integral panel portions on the lower ends of front panel 22 and back panel 24. The front panel 22 includes a lower angled panel portion 36 hingedly connected by means of fold line 38 to the major portion of panel 22. At its lower end, opposite the major portion of panel 22, the lower angled panel portion 36 has an outer integral base panel 40 hingedly connected thereto by means of a fold line 42. Both first opening 26 and second opening 30 in said front panel 22 extend into said front lower angled panel portion 36. The back panel 24 includes a lower angled panel portion 44 which is slightly smaller than panel portion 36, hingedly connected by means of fold line 46 to the major portion of panel 22. At its lower end, opposite the major portion of panel 24, the lower angled panel portion 44 has an inner flap 50 with tabs 52 hingedly connected thereto by means of fold line 54. A glued area 55 on panel portion 40 lies between a fold line 56 and the end 58 of the panel portion 40. All of the glue, both areas 35 and area 55 are thus on the inside for ease of automatic manufacture.

Figure 4A:
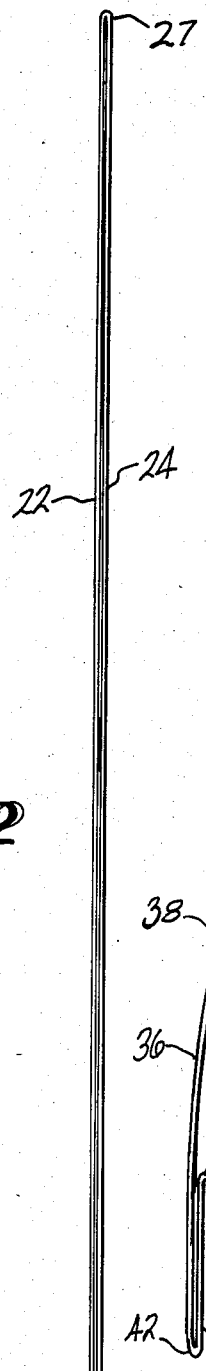
FIG. 4*a* is an enlarged fragmentary side elevational view of the lower end of FIG. 4.
Figure 3:
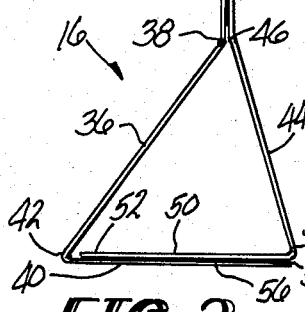
FIG. 3 is a side elevational view of the empty erected paperboard blank.
Figure 4:
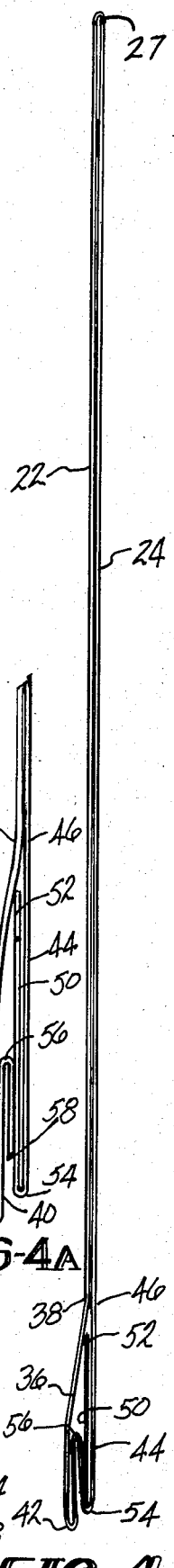
FIG. 4 is a side elevational view of a flattened form of the package suitable for shipping in bulk, which flattened form is produced by folding and gluing the blank of FIG. 2.
Figure 7:
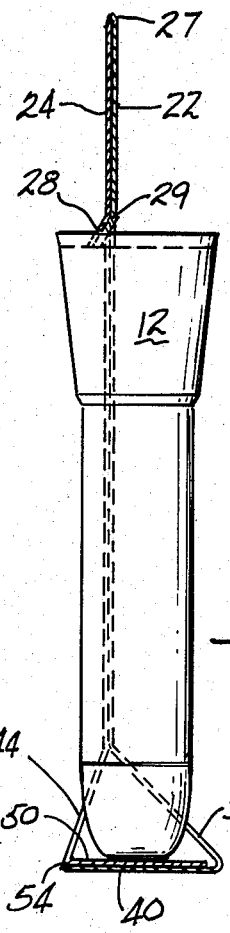
FIG. 7 is a cross-sectional elevational view taken along the line 7—7 of FIG. 5.
Figure 6:
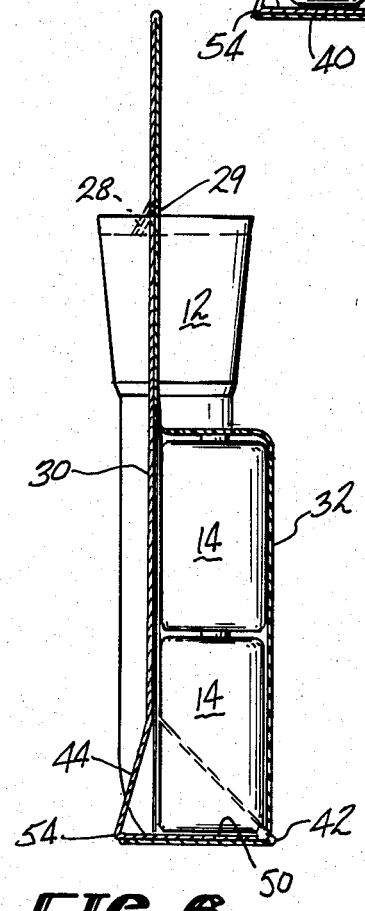
FIG. 6 is a cross-sectional elevational view taken along the line 6—6 of FIG. 5.
Figure 5:
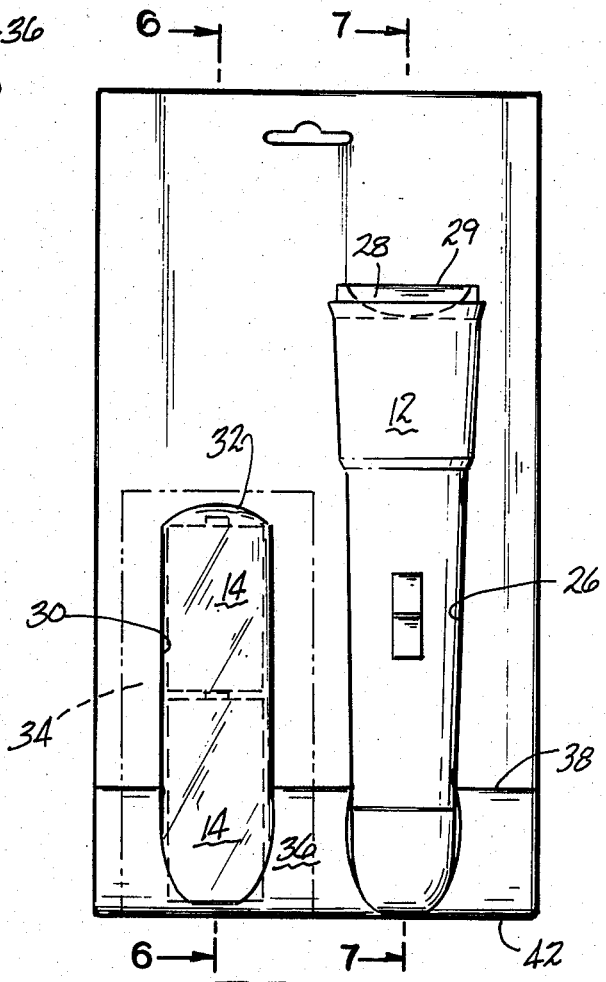
FIG. 5 is a front elevational view of the erected carton with a flashlight and batteries in place.

To erect and assemble the blank 20 to the bulk shipping flattened form shown in FIG. 4 and 4*a*, the front panel 22 is folded along fold line 27 into register with the back panel and into contact such that adhesive areas 35 hold the panels together. The panel portions in the lower end are folded as shown in detail in FIG. 4*a* with glue area 55, adjacent panel end 58 in adhesive contact with inner flap 50. Panel portion 40 is hinged for folding at 56 but opens and remains flat when inner reinforcement flap 50 is brought down flat and parallel with it to make the triangular base 16 as shown in FIGS. 1 and 3. The weight of the flashlight 12 and the battery loaded blister 32 thus hold the stand 16 in triangular shape.

While the preferred embodiment of the package is particularly adapted for holding flashlights, it will be readily appreciated that the principles of the invention can be applied equally well to packages adapted to hold articles other than flashlights. The package of this invention provides for positive retention of relatively bulky articles despite the package itself being relatively flat. The package can be made from a unitary blank which can be folded and glued to form a flattened form of the package which is particularly suited for bulk shipment of the packages from the point of manufacture to the point of use. The flattened forms can be readily expanded to a form ready for reception of the articles to be packaged, the expansion being manually or mechanically performable. When filled, the packages may be used as a point of purchase display either by standing on a shelf or by hanging from a hook.

Since many changes and variations of the disclosed embodiment of the invention may be made without departing from the inventive concept, it is not intended to limit the invention otherwise than as required by the appended claims.

What is claimed is:

1. An article display package for a flashlight and battery combination comprising:

(a) a paperboard front panel;

(b) a paperboard back panel foldably connected to one edge of said front panel, said back panel being juxtaposed and secured at secured portions in face to face relationship with said front panel by securing means;

(c) means forming an article receiving first opening, said article receiving opening including article encircling opening edges in said front and back panels, said opening edges being configured substantially to the shape of the article to be received in the opening to retain the article in the opening;

(d) means forming an article receiving second opening, said second opening including edges encircling an article holding blister, said blister being configured substantially to the shape of a second article;

(e) a passageway between secured portions of said front and back panels communicating said first and the full length of said second openings with each other for packing of said second opening with product;

(f) front and back lower angled panels foldably connected respectively to said front and back panels along fold lines which are parallel to the foldable connection between said front and back panels and equally spaced therefrom, said front and back lower angled panels being angled away from one another and angularly aligned with respect to the plane of said front and back panel;

(g) said first and second openings in said front panel extending into said front lower angled panel; and, (h) said front and back lower angled panels foldably connected together having an inner bottom flap and an outer integral base to create a reinforced triangular stand.

2. The package of claim 1, in which said opening edges have the general configuration of a flashlight and further comprise top flap means at one end of said opening to engage the lens of a flashlight disposed in said opening to aid in retaining said flashlight in said opening.

3. The package of claim 1 in which said opening extends into said triangular stand.

4. The package of claim 3 in which the triangular stand folds substantially flat in substantially the plane of the package for shipment and storage when said carton is empty.

5. The package of claim 1 in which a portion of said inner flap is adhered to a portion of said outer integral base.

6. The package of claim 1 in which said package has a hook receiving opening.

* * * * *